US006114816A

United States Patent [19]

Nuckolls et al.

[11] Patent Number: 6,114,816

[45] **Date of Patent: *Sep. 5, 2000**

[54] LIGHTING CONTROL SYSTEM FOR DISCHARGE LAMPS

[75] Inventors: Joe Allen Nuckolls; Isaac Lynnwood Flory, IV, both of Blacksburg, Va.

[73] Assignee: Hubbell Incorporated, Orange, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/745,246

[22] Filed: Nov. 8, 1996

Related U.S. Application Data

[63] Continuation of application No. 08/357,394, Dec. 16, 1994, abandoned.

[51] Int. Cl.[7] ..... H05B 37/02

[52] U.S. Cl. ..... 315/324; 315/240

[58] Field of Search ..... 315/240, 324

[56] References Cited

U.S. PATENT DOCUMENTS

| | | | |
|---|---|---|---|
| 2,449,456 | 9/1948 | Croco et al. | 315/276 |
| 2,985,762 | 4/1961 | Euler, Jr. | 315/106 |
| 3,249,807 | 5/1966 | Nuckolls | 315/199 |
| 3,317,789 | 5/1967 | Nuckolls | 315/194 |
| 3,418,527 | 12/1968 | Miller | 315/278 |
| 3,678,371 | 7/1972 | Nuckolls | 323/6 |
| 3,710,184 | 1/1973 | Williams | 315/227 |
| 3,857,060 | 12/1974 | Chermin | 315/99 |
| 3,917,976 | 11/1975 | Nuckolls | 315/258 |
| 3,963,958 | 6/1976 | Nuckolls | 315/276 |
| 3,997,814 | 12/1976 | Toho | 315/200 |
| 4,015,167 | 3/1977 | Samuels | 315/99 |
| 4,017,761 | 4/1977 | Woldring | 315/99 |
| 4,209,730 | 6/1980 | Pasik | 315/290 |
| 4,378,514 | 3/1983 | Collins | 315/276 |
| 4,443,740 | 4/1984 | Goralnik | 315/284 |
| 4,562,381 | 12/1985 | Hammer et al. | 315/99 |
| 4,626,745 | 12/1986 | Davenport et al. | 315/179 |
| 4,859,914 | 8/1989 | Summa | 315/354 |

(List continued on next page.)

FOREIGN PATENT DOCUMENTS

| | | |
|---|---|---|
| 52-18077 | 2/1977 | Japan . |
| 52-18078 | 2/1977 | Japan . |
| 52-49678 | 4/1977 | Japan . |
| 54-98066 | 8/1979 | Japan . |

OTHER PUBLICATIONS

Philips Lighting "IFS800 Lighting control system" Oct. 1990.

Rudd Lighting, Inc., Product Brochure.

*Primary Examiner*—Michael B Shingleton

*Attorney, Agent, or Firm*—Jerry M. Presson; Stacey J. Longanecker

[57] ABSTRACT

A lighting control system for discharge lamps which comprises a ballast for supplying energy from a power source to a lamp. First and second capacitors and a first control relay and contact set control the supply of energy from the ballast to the lamp to switch the lamp between dimmed and normal wattage operational modes. A second control relay and contact set connects a single output control wire to neutral when a predetermined condition is sensed or a switch is thrown. The first control relay, which is connected at one end to the lamp ballast, is energized when the other end thereof is connected to neutral via the second control relay. The first control relay in turn closes the normally open contact set, which is connected to one of the capacitors, to increase the energy provided to the lamp. In accordance with one embodiment the first capacitor and the contact set of the first control relay are connected in series, and together are connected parallel to the second capacitor. In accordance with another embodiment, the first and second capacitors are connected in series, and the contact set of the first control relay is connected parallel to the first capacitor.

30 Claims, 12 Drawing Sheets

U.S. PATENT DOCUMENTS

| | | | |
|---|---|---|---|
| 4,866,347 | 9/1989 | Nuckolls et al. | 315/158 |
| 4,888,507 | 12/1989 | Ham | 315/244 |
| 4,891,562 | 1/1990 | Nuckolls et al. | 315/277 |
| 4,914,354 | 4/1990 | Hammer et al. | 315/247 |
| 4,958,107 | 9/1990 | Mattas et al. | 315/289 |
| 4,994,718 | 2/1991 | Gordin | 315/240 |
| 5,001,401 | 3/1991 | Costa et al. | 315/278 |
| 5,047,694 | 9/1991 | Nuckolls et al. | 315/290 |
| 5,049,789 | 9/1991 | Kumar et al. | 315/289 |
| 5,055,747 | 10/1991 | Johns | 315/307 |
| 5,173,643 | 12/1992 | Sullivan et al. | 315/276 |
| 5,210,471 | 5/1993 | Nuckolls et al. | 315/289 |
| 5,216,333 | 6/1993 | Nuckolls et al. | 315/291 |
| 5,289,110 | 2/1994 | Slevinsky | 323/301 |
| 5,309,065 | 5/1994 | Nuckolls et al. | 315/205 |
| 5,321,338 | 6/1994 | Nuckolls et al. | 315/290 |
| 5,327,048 | 7/1994 | Troy | 315/DIG. 4 |
| 5,406,174 | 4/1995 | Slegers | 315/219 |
| 5,477,113 | 12/1995 | Christoffersson | 315/278 |

STEP DIMMING - 400W MH BALLAST #71A6041

| CAP | VIN | AIN | WIN | PF | VLAMP | ALAMP | WLAMP | F.C. | C.F. | VCAP |
|---|---|---|---|---|---|---|---|---|---|---|
| 24 | 432 | 0.967 | 410.5 | 0.98 | 129.4 | 2.98 | 357.6 | 763 | 1.63 | 343.1 |
| | 480 | 0.98 | 464 | 0.99 | 132.8 | 3.25 | 401.2 | 957 | 1.61 | 352 |
| | 528 | 0.99 | 512.4 | 0.98 | 136.2 | 3.51 | 440 | 1120 | 1.6 | 381 |
| 20 | 432 | 0.7 | 298.8 | 0.99 | 122.8 | 2.36 | 259.1 | 416 | 1.72 | 328.2 |
| | 480 | 0.71 | 335.5 | 0.98 | 124.9 | 2.57 | 288.6 | 497 | 1.7 | 353.8 |
| | 528 | 0.77 | 375.8 | 0.93 | 127.8 | 2.78 | 321.2 | 606 | 1.69 | 377.7 |
| 18 | 432 | 0.59 | 248.8 | 0.98 | 120.8 | 2.06 | 217.4 | 289 | 1.74 | 320.9 |
| | 480 | 0.61 | 283.6 | 0.96 | 121.3 | 2.24 | 241.7 | 379 | 1.73 | 345.1 |
| | 528 | 0.7 | 317.4 | 0.85 | 122.7 | 2.42 | 264.5 | 441 | 1.7 | 368.4 |
| 16 | 432 | 0.51 | 211.1 | 0.96 | 117.3 | 1.79 | 181.8 | 218 | 1.76 | 312.6 |
| | 480 | 0.54 | 235.4 | 0.9 | 120.1 | 1.94 | 200.2 | 255 | 1.8 | 336.1 |
| | 528 | 0.67 | 263.1 | 0.75 | 120.9 | 2.09 | 218 | 294 | 1.77 | 358.5 |

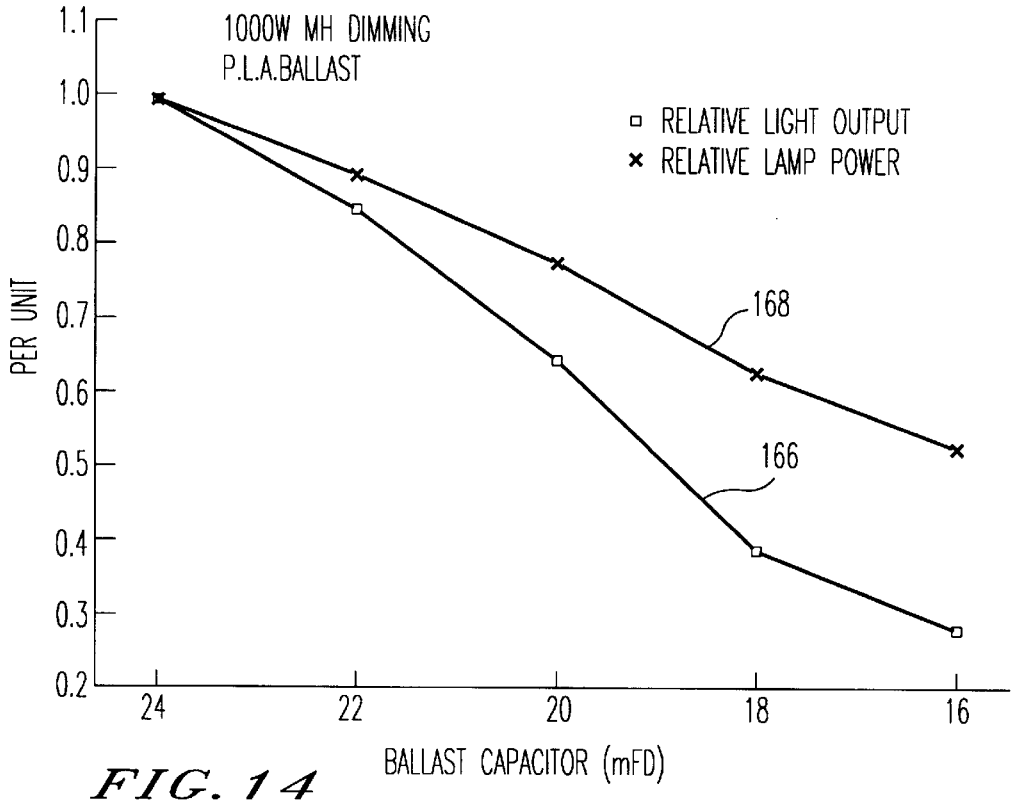
FIG. 14
FIG. 15
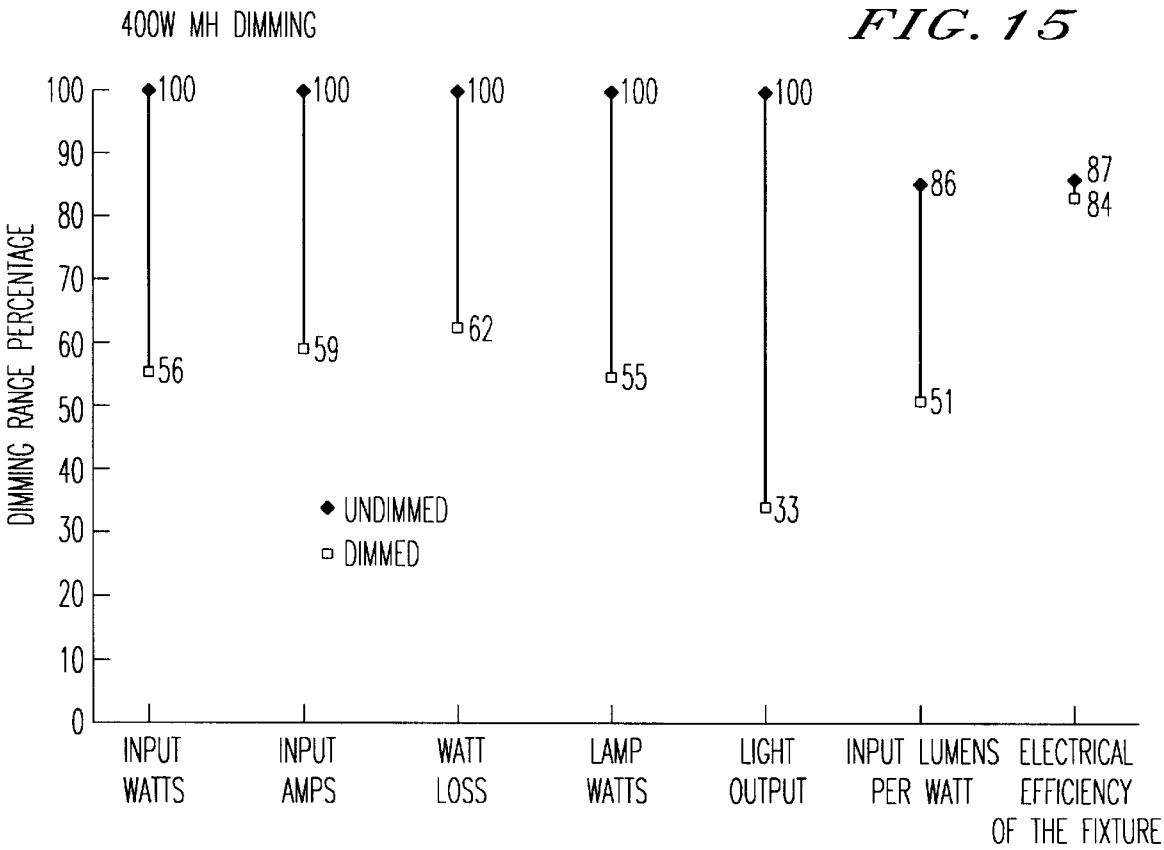

LIGHTING CONTROL SYSTEM FOR DISCHARGE LAMPS

This is a continuation of application Ser. No. 08/357,394 filed Dec. 16, 1994, now abandoned.

FIELD OF THE INVENTION

The invention relates to a lighting control system and, more particularly, to a two level dimming control system for discharge lamps such as metal halide, high pressure sodium and other high intensity discharge lamps.

BACKGROUND OF THE INVENTION

Many commercial, industrial, and government facilities, indoor as well as outdoor, require a significant number of lighting fixtures for adequate illumination, and therefore use a significant amount of power to operate the fixtures. To reduce the power to light these facilities, as well as the cost of maintaining them (e.g., replacing bulbs), a number of facilities use high intensity discharge (HID) light sources including metal halide (MH) and high pressure sodium (HPS) lamps, as well as other discharge lamps, in lieu of incandescent lamps.

Although use of discharge lamps alone can reduce power consumption as compared to incandescent lamps, energy consumption can be further reduced by dimming systems which control when and the level to which these discharge lamps are energized. For example, step-dimming systems, such as two-level or high-low lighting control systems, can be used to switch facility fixtures between energy-saving low level or reduced-wattage operation and full level or normal-wattage operation. Thus, light fixtures, for example, in office buildings, prisons, warehouses, convention centers, stadiums, tunnels, roadways, parking facilities and the like can be dimmed or illuminated to normal-wattage operation automatically in accordance with occupancy level, ambient light level, time, and manual switching, among other conditions. Step-dimming systems can therefore reduce energy consumption, increase security and/or provide multi-function lighting levels.

U.S. Pat. No. 5,216,333 to Nuckolls et al., which is hereby incorporated herein by reference in its entirety, discloses a step-dimming magnetic regulator which increases or reduces light output from a discharge lamp in accordance with the output signals from a motion sensor. As shown in the attached FIG. 1, a magnetic regulator 10 comprises a primary winding 12, the line wire L and neutral wire N of which are connected to an AC power source. The regulator also comprises a secondary winding 14 and a tertiary winding 16 magnetically coupled, together with the primary winding, by a laminated core 18. The secondary winding 14 has a tap 15 connected to a starting circuit 21 for providing high voltage pulses to the discharge lamp 22. The tertiary winding 16 is the capacitance winding of the regulator 10. A capacitor 24 is connected between the ends of the tertiary winding. The winding 16 is also provided with a tap 26 which is used to operate a dimming reactor 30.

With continued reference to FIG. 1, the reactor 30 is connected in series with a switchable conductive path comprising a normally closed contact set 32 between one end of the winding 16 and the center tap 26. An electromagnetic actuator, e.g., a relay winding 28, opens the contact set 32 when a switch 34 is actuated. The switch 34 can be, for example, an infrared (IR) sensor which reduces its internal resistance to near zero when a condition, such as a human body moving within its area of sensitivity. The switch 34 is connected between the neutral wire N and the relay winding 28 by single control wire 44. When the switch 34 is actuated, relay 28 is connected between a center tap 13 on the primary winding and the neutral wire N via the control wire 44. When the wire 44 is connected to neutral, the relay 28 is energized and therefore opens the contact set 32. When the contact set 32 is open, the reactor 30 has no effect on circuit operation. When the contact set 32 is closed, the reactor 30 extracts positive volt-amperes and stores that energy each half-cycle, thereby reducing the amount of energy stored by capacitor 24 for operating the lamp. The lamp is therefore dimmed. A plurality of lamp and dimmer units 40*a*, 40*b* can be connected to the same switch by a single wire.

With reference to FIG. 2, the Nuckolls U.S. Pat. No. 5,216,333 further discloses an arrangement of sensors 67 and 68 and regulator and lamp units 66 in a room or aisle 64. The units 66 comprise the regulator, lamp dimming reactor and switchable conductive path discussed in connection with FIG. 1. When motion is sensed by either sensor 67 or 68, the dimming reactors are removed from the circuit, allowing light output from all of the lamps to be increased promptly. More specifically, a power supply 72 supplies a low DC voltage to each of the motion sensors 67 and 68. The output of the sensors 67 and 68 are connected to relays 74 and 75, respectively. The relays 74 and 75 have normally open contact sets 76 and 77, respectively, which close when the relays are energized. The lamp units 66 has an internal relay and control wire similar to the relay 28 and control wire 44 described in connection with FIG. 1. When either sensor detects motion, relay 74 or 75 closes its contact set, connecting the control wire for all fixtures to neutral. Thus, the internal relay in each lamp is energized to remove its internal ballast and increase lamp output.

With reference to FIG. 3, another lighting control system manufactured by Ruud Lighting, Inc. of Racine, Wash. for providing two level (i.e., high-low) lighting comprises an internal switching device and a single control wire. The fixtures 80*a*, 80*b* and 80*c* receive power from a three-phase power source 82, and the voltage supplied thereby is phase-to-neutral or ground. A control module 84 receives power from a power pack 86 and comprises a sensor 88 (e.g., a passive infrared occupancy sensor) and a manual override switch 90. When a human body is detected by the sensor 88, or the switch 90 is closed, a contact set (not shown) within the control module connects the single control wire 92 leading to the fixtures to the voltage potential.

The lighting system in the Nuckolls U.S. Pat. No. 5,216,333 and the Ruud lighting system are disadvantageous for a number of reasons. For example, the Ruud system switches to a line voltage, which is not as safe as switching to neutral. The Nuckolls patent is disadvantageous because it uses a reactor (e.g., reactor 30 in FIG. 1) which increases the size and cost of the control system.

SUMMARY OF THE INVENTION

In accordance with the present invention, a lighting fixture control system which is constructed with a minimum number of parts and connecting wires at minimum cost and complexity and which is safe and easy to maintain.

The lighting control system is a step-dimming system for at least one discharge lamp comprising a ballast, first and second capacitors, and a first control relay and contact set contained, together with the lamp, in a fixture housing. The step-dimming system further comprises an alternating current power source for supplying a line voltage to the ballast. The fixture has first and second terminals connected to a line voltage wire and a neutral wire of the power source. The supply of energy from the ballast to the lamp is controlled for the most part by the first and second capacitors, together with the first control relay and contact set. The first control relay is connected to a third terminal of the fixture housing, which is adapted to receive a control wire from a second control relay and contact set located remotely from the fixture housing.

The second control relay and contact set are preferably located in a remote sensor housing, but can be located in any other control enclosure being used as a wiring or control center. When the sensor detects a predetermined condition (e.g., motion of a human body within a warehouse aisle), the second control relay is operable to close a normally opened contact set, thereby connecting the neutral wire and the output control wire. The output control wire is the only connection between the sensor and the fixture housing. By connecting the control wire to the neutral wire, the first control relay is energized, causing the normally open contact switch, which is connected to one of the capacitors, to close. Accordingly, the lamp is switched from a dimmed mode to a normal wattage mode due to the net increase in capacitance.

In accordance with one embodiment of the present invention, the first capacitor and the contact set of the first control relay are connected in series with each other, and together are connected parallel to the second capacitor. In another embodiment of the present invention, the first capacitor and the second capacitor are connected in series with each other, and the contact set of the first control relay is connected parallel to the first capacitor. In each of these embodiments, the closure of the normally open contact set associated with the first control relay increases ballast capacitance, and therefore more energy is supplied to the lamp. The lamp therefore is switched to a normal wattage operational mode from a dimmed mode.

The switching of the output control wire of the sensor to neutral permits the use of a standard 4-pin plug and receptacle arrangement. Further, interference from noise attributable to low voltage control signals is avoided.

In accordance with another aspect of the present invention, the ballast is provided with a tap, which in turn is connected to the first control relay. The first control relay therefore receives a line voltage from the main power source of the control system via the ballast primary winding, as opposed to a separate power source. This configuration reduces the risk of electrocution to electricians, since they need only turn off the main power supply to perform maintenance work on a fixture.

By placing the second control relay and contact set between the neutral and control wires of the fixture, a variety of sensors and switch devices can be installed with relative ease to control the fixture. For example, the fixture can be connected to motion sensors, ambient light sensors, manual override switches, or control input devices for activating the first control relay in response to the receipt of radio frequency or infrared signals, as well as combinations of these sensors, switches, and devices.

In accordance with another aspect of the invention, a sensor can be connected to a relaxation oscillator to automatically flash the lamp at an attention-getting rate when, for example, a smoke detector or other type of sensor detects an undesirable condition or security breach.

BRIEF DESCRIPTION OF THE DRAWINGS

These and other features and advantages of the present invention will be more readily apprehended from the following detailed description when read in connection with the appended drawings, in which:

FIG. 14 is a graph illustrating an exponential decrease in lamp output with respect to decreasing lamp power; and FIG. 15 is a chart illustrating a reduction in discharge lamp efficiency when operating in a dimmed mode.

DETAILED DESCRIPTION OF THE PREFERRED EMBODIMENT

Figure 1:
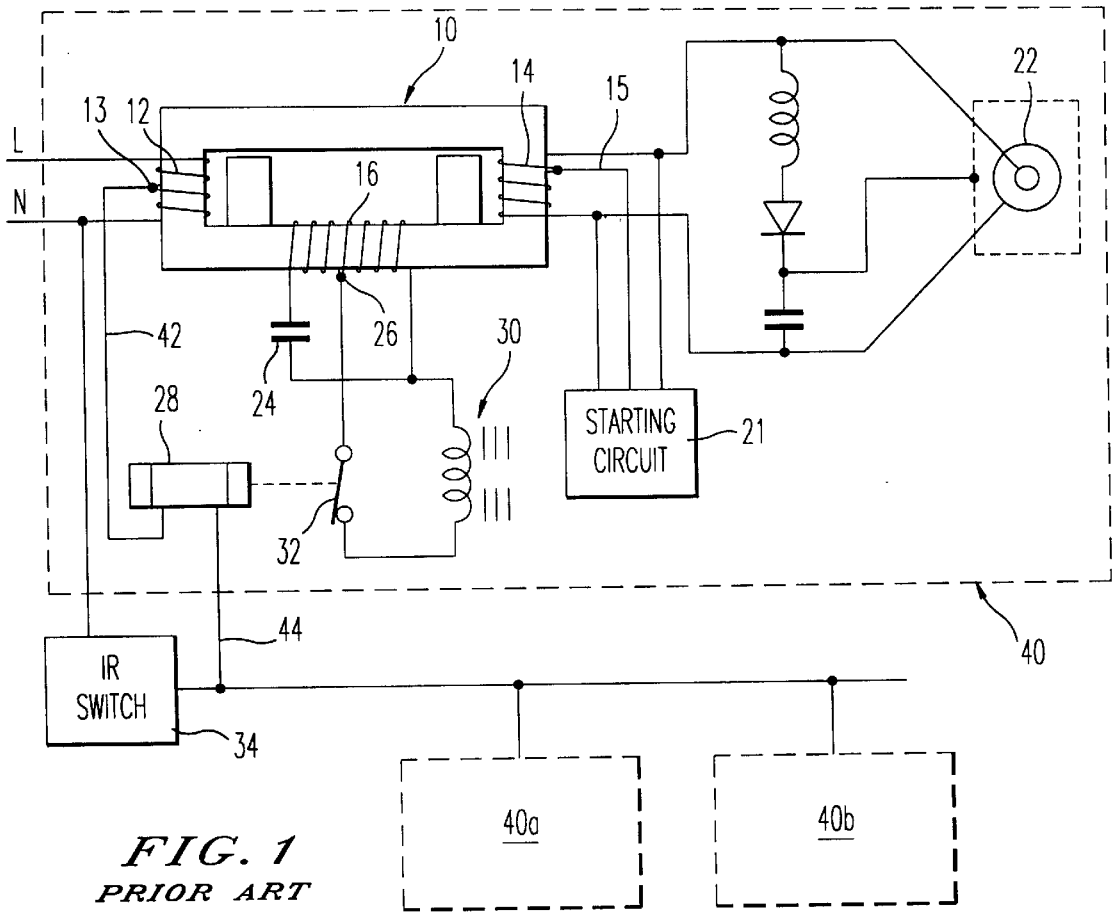
FIG. 1 PRIOR ART
FIG. 1 is a schematic diagram of a step-dimming magnetic regulator in the prior art.
Figure 2:
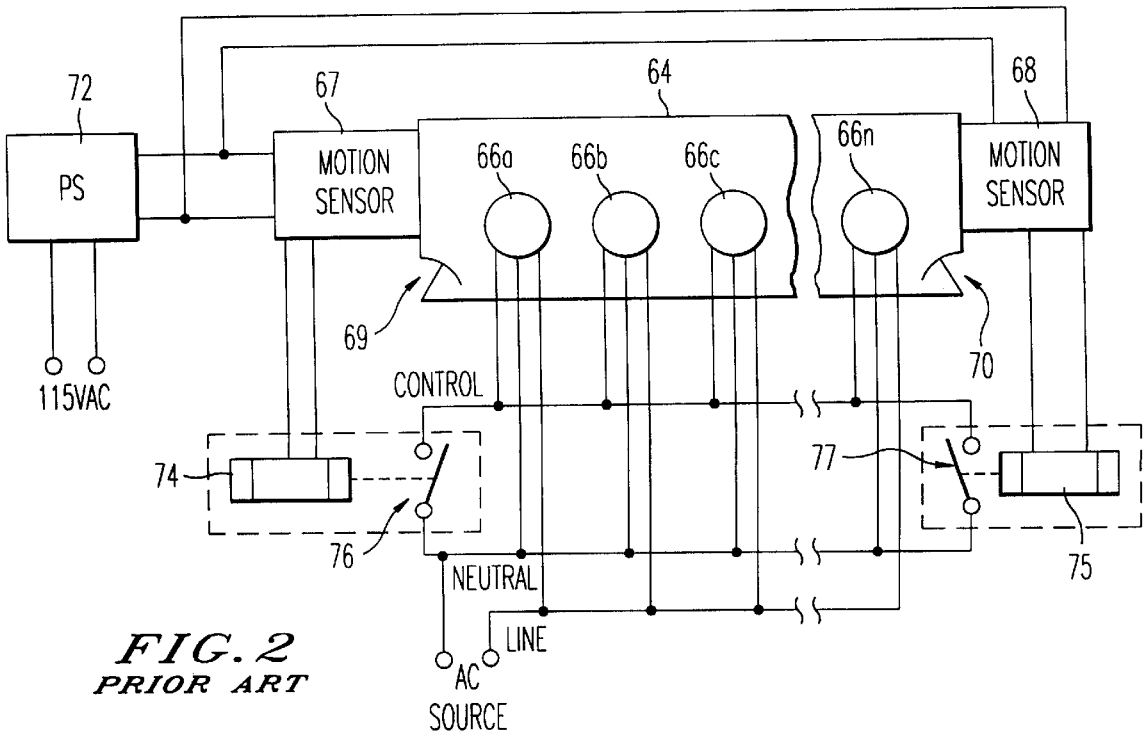
FIG. 2 PRIOR ART
FIG. 2 is a schematic diagram of a step-dimming control system for a plurality of fixtures arranged in an aisle, in accordance with the prior art.

In accordance with the present invention and as described below in connection with FIG. 5, a control system 104 (e.g., a step-dimming system) for dimming one or more lamps 122 comprises a power supply 124, a ballast 126, first and second capacitors C1 and C2, a first control relay 136 and corresponding contact set 142, a second control relay 114 and corresponding contact set 112. A light fixture 100 preferably encloses the ballast 126, the lamp 122, a starter circuit 134, the capacitors C1 and C1 and the control relay 136 and contact set 142. The second control relay 114 and contact set 112 are generally located outside the fixture 100, that is, inside a sensor, switch or other control device.

Figure 4:
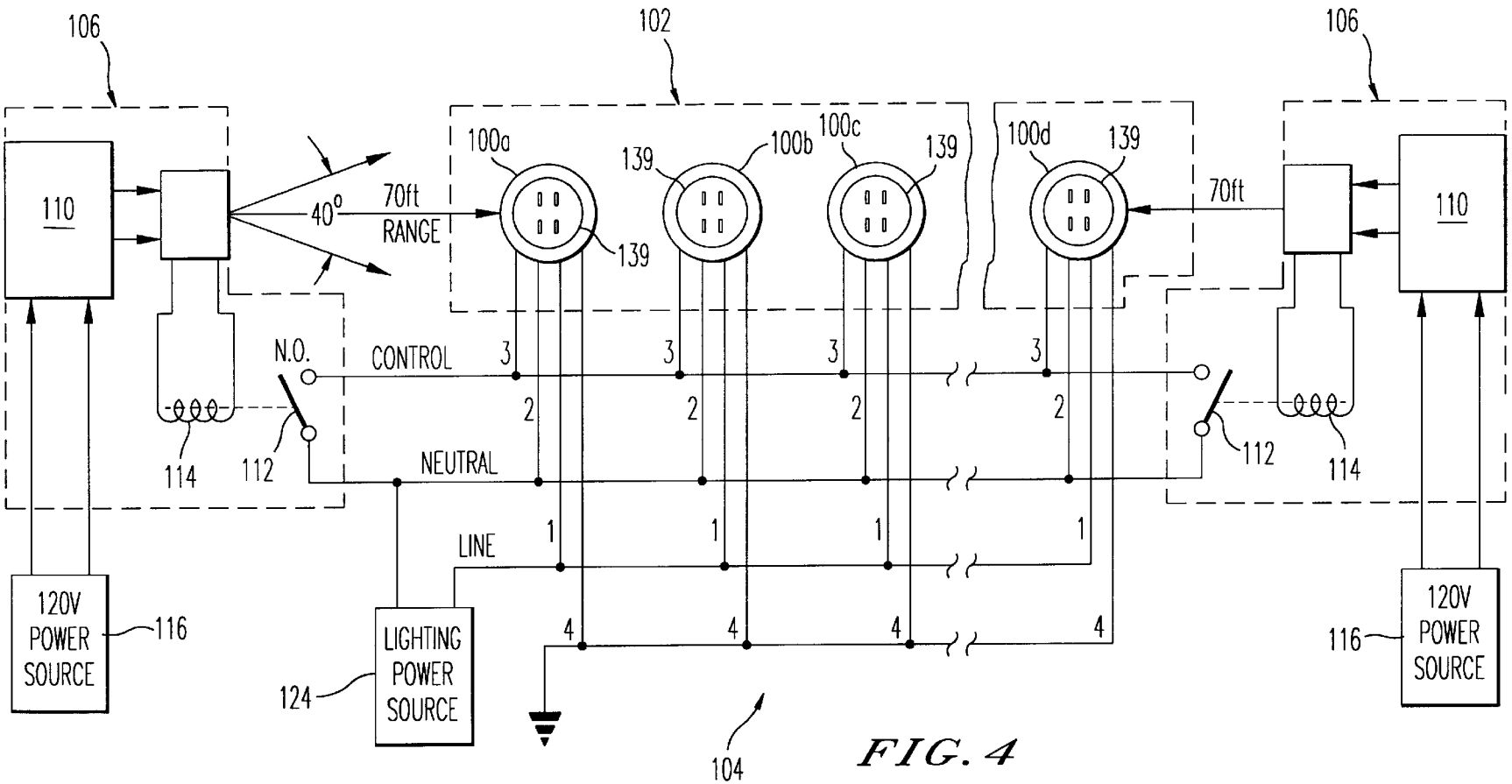
FIG. 4 is a schematic diagram of a control system for a number of lighting fixtures arranged in a row or aisle which is constructed in accordance with the present invention.

In a warehouse, as shown in FIG. 4, a number of lighting fixtures 100*a*, 100*b*, 100*c*, and so on, are suspended from a ceiling or other surface in a row 102 to illuminate, for example, an aisle in the warehouse. Each fixture in the aisle 102 is preferably controlled by a control system, indicated generally at 104 and constructed in accordance with the present invention. The control system 104, however, can operate in conjunction with an individual lighting fixture or a multitude of fixtures such as a number of rows of fixtures extending along several warehouse aisles.

With continued reference to FIG. 4, each aisle is preferably provided with at least one sensor 106. The sensor is operable to control the switching of the lamps between dimmed and essentially full illumination modes. The sensor is preferably a motion sensor, although a variety of sensors can be used, as will be described below in connection with FIG. 13. For example, a Model 852C Motion Sensor made by Eltec Instruments, Inc. of Daytona Beach, Fla. can be modified in accordance with the present invention. These sensors have a viewing angle of about 40 degrees and a sensing range of about 70 feet. Two sensors 106 therefore can be positioned as shown in FIG. 4 to monitor an aisle approximately 140 feet long.

The Model 852C sensor 106 is modified to have an input for a 120 volt AC (VAC) power source 116, and relay coil 114, and a set of isolated relay contacts 112 at the output which can switch 120 VAC fixture relay coil loads (i.e., 3 amperes inductive minimum current rating). The output relay contacts are preferably normally open (NO) such that when a human body is detected within the sensor field, the contacts are closed.

The motion sensor 106 is preferably provided with a 120 VAC input power signal from a source other than the lamp power source described in connection with FIG. 5. The sensor can also be provided with a time-delay circuit. Accordingly, when the sensor input 120 VAC signal is first applied, (e.g., during cold lamp warm-up), or when there is a momentary AC power outage, the output relay contacts are closed for approximately 15 minutes in order to effect full discharge lamp 122 warm-up before dimming can take place.

The relay in the motion sensor is preferably a single-pole, single-throw (SPST), NO, 120 VAC relay model #20837-85275F 30A manufactured by Deltrol Controls of Milwaukee, Wis. This type of relay is capable of withstanding temperatures up to 155 degrees celsius. A control unit 110 in the motion sensor relay provides the motion sensor 0.1 to 0.3 seconds to sense a power outage. The relay is operable to illuminate a lamp or lamps, preferably an adjustable amount of time between 1 and 3 minutes so that an aisle is illuminated even after people have exited therefrom.

With continued reference to FIG. 4, each fixture 100 is connected to a power source 124 and a motion sensor 106 by a standard 4-pin plug and connector 139. A fixture 100 is provided with power from the power source 124 via a line voltage wire and a neutral wire corresponding to terminals 1 and 2, respectively. Each fixture is connected to an output control wire from the sensor via a terminal 3. Finally, each lamp is connected to building ground via a terminal 4.

Figure 5:
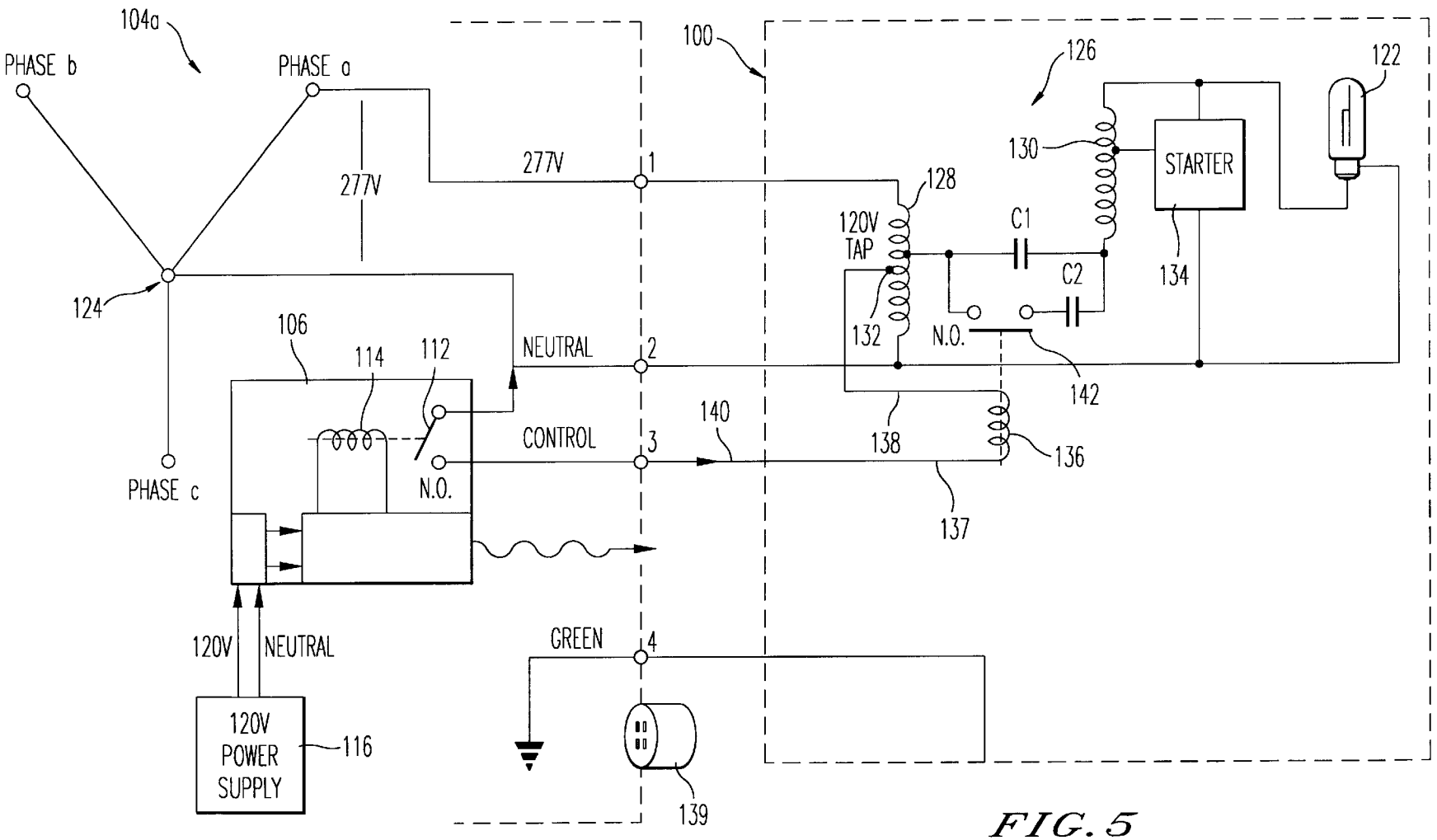
FIG. 5 is a schematic diagram of a lighting control system comprising a single fixture and a single sensor constructed in accordance with an embodiment of the present invention wherein a first capacitor and the contact set of a control relay are connected in series with respect to each other, and together are connected parallel to another capacitor.

Referring to FIG. 5, the control system 104 is shown connected to its power source 124 and to the motion sensor 106 or other type of sensor using the above-mentioned standard 4-pin plug and connector. A single lamp 100 is shown in greater detail. The lamp 100 is preferably a HPS or a MH lamp, although other types of HID lamps of various rated wattages can be used. The two terminals 1 and 2 at the respective ends of a ballast 126 are connected to the power source 124. The power source is preferably a 480 volt line-to-line, 277 volt line-to-neutral, three phase AC line voltage source. The terminal 1 is connected to the 277 volt line input of the AC line voltage source, while the other terminal 2 is connected to the neutral wire. Alternatively, a single phase power source can be used. As will be described below, a single control wire (terminal 3) is used in accordance with the present invention to interface the control system 104 to one or more of a number of different types of sensors (e.g., a motion sensor, an ambient light detector, a noise detector, and so on). The invention is advantageous because, among other reasons, it avoids large bundles of control wires used together with an AC power and green wire ground wiring scheme in many prior lighting control systems.

The ballast 126 is coupled to two capacitors C1 and C2. The ballast can be, for example, a core and coil Advance type 71A8492 manufactured by Advance Transformer Corporation, Chicago, Ill., although other lead types of ballasts can be used. The ballast shown in FIG. 5 is a continuous wattage autotransformer (CWA) for use with a HPS lamp. Alternatively, a peak lead autotransformer (PLA) such as model 71A6041 manufactured by Advance Transformer Corporation, can be used with an MH lamp. The invention is not limited to the aforementioned CWA and PLA-type ballasts. Different types of ballasts can be used to accommodate different lamp and wattage types.

The ballast comprises primary and secondary windings 128 and 130, respectively. A 120 VAC tap 132 is provided on the primary winding. A starter circuit 134 connected to the secondary winding 130 aids in lamp ignition. The starter circuit 134 can be, for example, a positive temperature coefficient (PTC) resistor or a solid state delay device such as model THD74115MA manufactured by Solid State Advanced Controls of Balwinsville, N.Y.

Figures 6, 7:
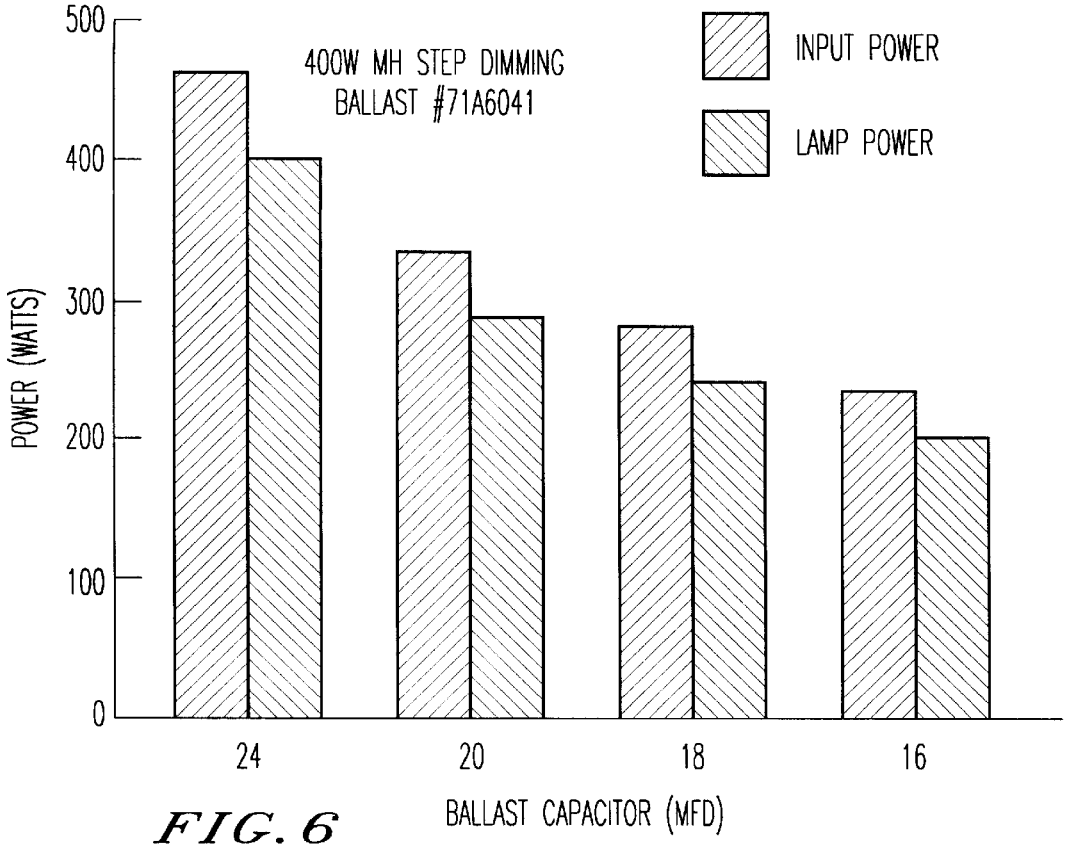
FIG. 6 is a graph and FIG. 7 is a table which illustrate the selection of ballast capacitances in accordance with a particular ballast and lamp type.

With reference to the graph in FIG. 6 and the table in FIG. 7, the ballast 126, the ballast capacitors C1 and C2, and the size of lamp 122 are chosen to maximize lamp performance and lumen-per-watt yield. By changing the ballast capacitors C1 and C2, the operation of the lamp is thereby effected. Current through the ballast is accordingly decreased or increased which in turn increases or decreases operating losses (that is, the lumens output by the lamp in comparison with the wattage applied to the system). The ballast capacitance C1 and C2 are generally selected experimentally. If the ballast capacitance is not chosen selectively to operate the lamp at its nominal design point, the performance of the lamp is compromised. The cost per unit lumen output increases with decreasing capacitance because the lamp output drops at a more rapid rate than does system power consumption. If the lamp is a 400 watt HPS lamp, then the capacitors C1 and C2 are preferably approximately 33 and 15 microfarads, respectively. If the lamp is a 400 watt MH lamp, then the capacitors C1 and C2 are preferably approximately 17 and 7 microfarads, respectively.

The in-fixture control relay 136 is preferably a single-pole single-throw (SPST), with NO silver cadmium-oxide contacts capable of switching 15 ampere inductive or capacitive loads and of holding off 600 volts. In accordance with the invention, the power voltage to operate the relay is derived from the 120 volt tap 132 from the fixture's ballast 126. Thus, one of the terminals 137 of the relay 136 is connected to the motion sensor output control wire, and the other relay terminal 138 is connected to the tap 132.

OPERATION

In operation, a reactance in series with the lamp 100 is varied by operation of the in-fixture control relay 136 to provide step-dimming control of the lamp and therefore generation of various light intensity levels. The C1 and C2 are shown in parallel in FIG. 5. The sensor 106 comprises an output control wire 140 coupled to the neutral wire via the relay 114 and contact set 112 in the sensor 106. When the sensor 106 senses a particular condition such as noise or movement within the sensor field of view, the relay 114 closes the NO contact set 112, electrically connecting the control wire 140 to the neutral wire. Accordingly, the in-fixture control relay 136 between the 120 volt ballast tap 132 and the neutral wire is energized and therefore closes contact set or switch 142. The reactance derived from placing capacitors C1 and C2 in parallel when the relay 136 is closed is reduced. Thus, more current flows to the lamp to illuminate it to a higher output percentage than when the lamp is maintained in its normally dimmed state.

Figure 8:
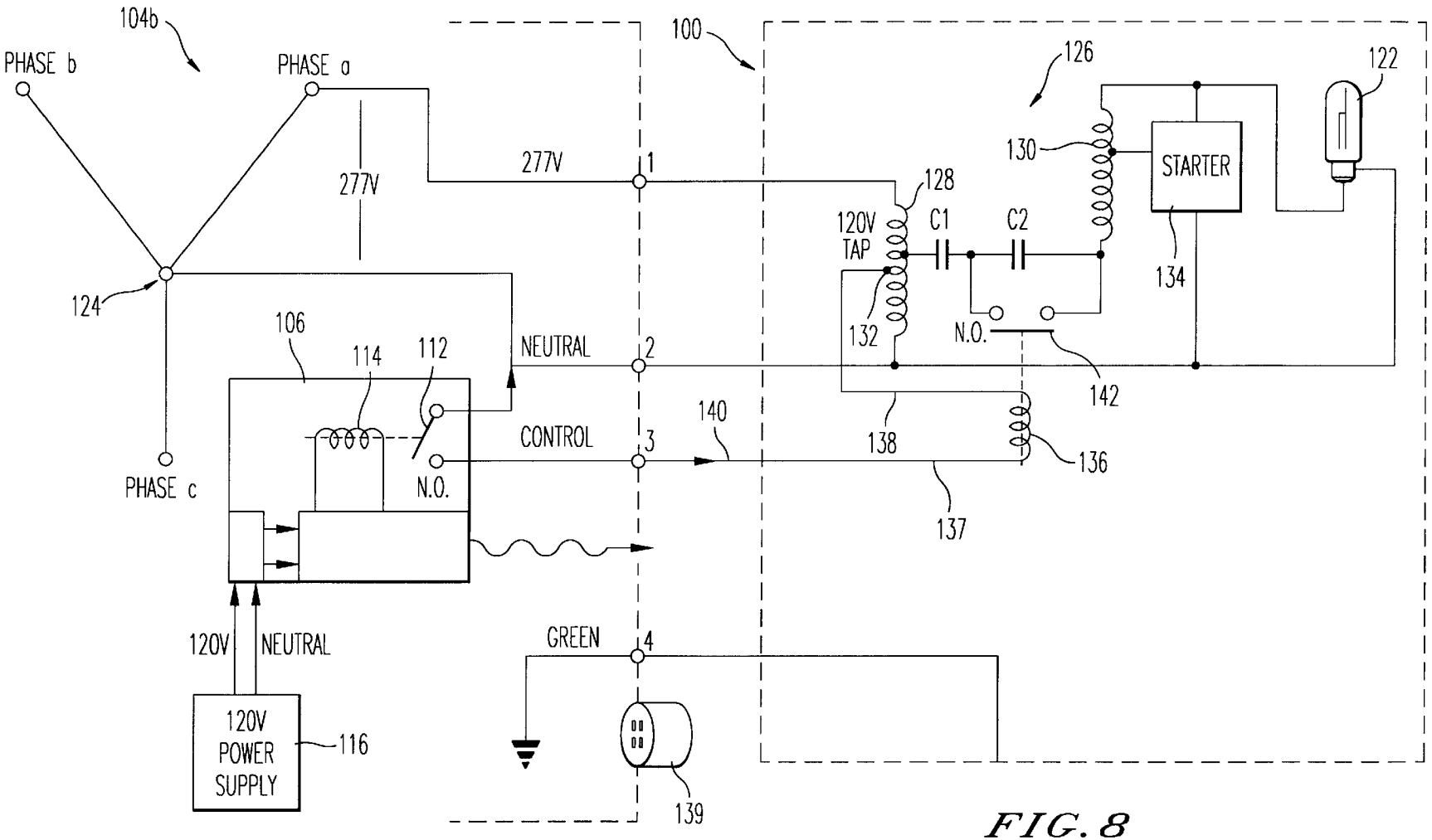
FIG. 8 is a schematic diagram of a lighting control system comprising a single fixture and single sensor constructed in accordance with another embodiment of the present invention wherein first and second capacitors are in series, and the contact set of a control relay is parallel to one of the capacitors.

The control system reactance or its reciprocal, its capacitance, is varied in FIG. 5 using capacitors C1 and C2 in a parallel configuration with the contacts 142 being in series with capacitor C2. Alternatively, the ballast capacitance can be varied by arranging capacitors C1 and C2 in series with each other, as shown in FIG. 8. The contacts 142 is parallel with respect to C2. The control system 104 operates in essentially the same manner as the circuit illustrated in FIG. 5. When the sensor detects, for example, a presence or ambient light or other condition, depending on what type of sensor is being used, the sensor relay 114 connects its single output control wire 140 to the neutral wire. The relay 136 in the fixture closes the contacts 142. The ballast capacitance increases and therefore increases lamp output to essentially full wattage operation from the dimmed mode.

Figure 9:
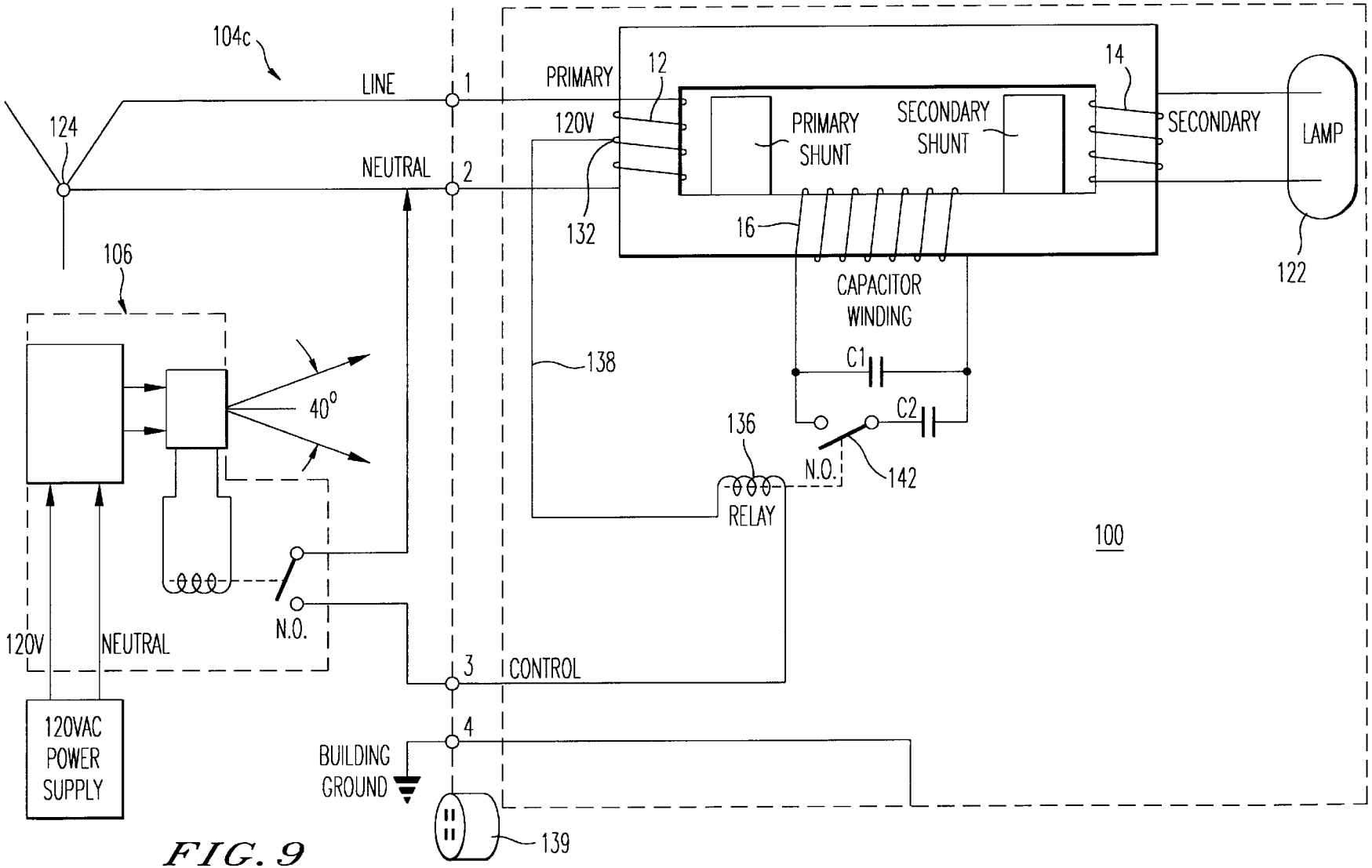
FIGS. 9 and 10 are schematic diagrams of a lighting control system constructed in accordance with the present invention for use with a fixture comprising a magnetic regulator.
Figure 10:
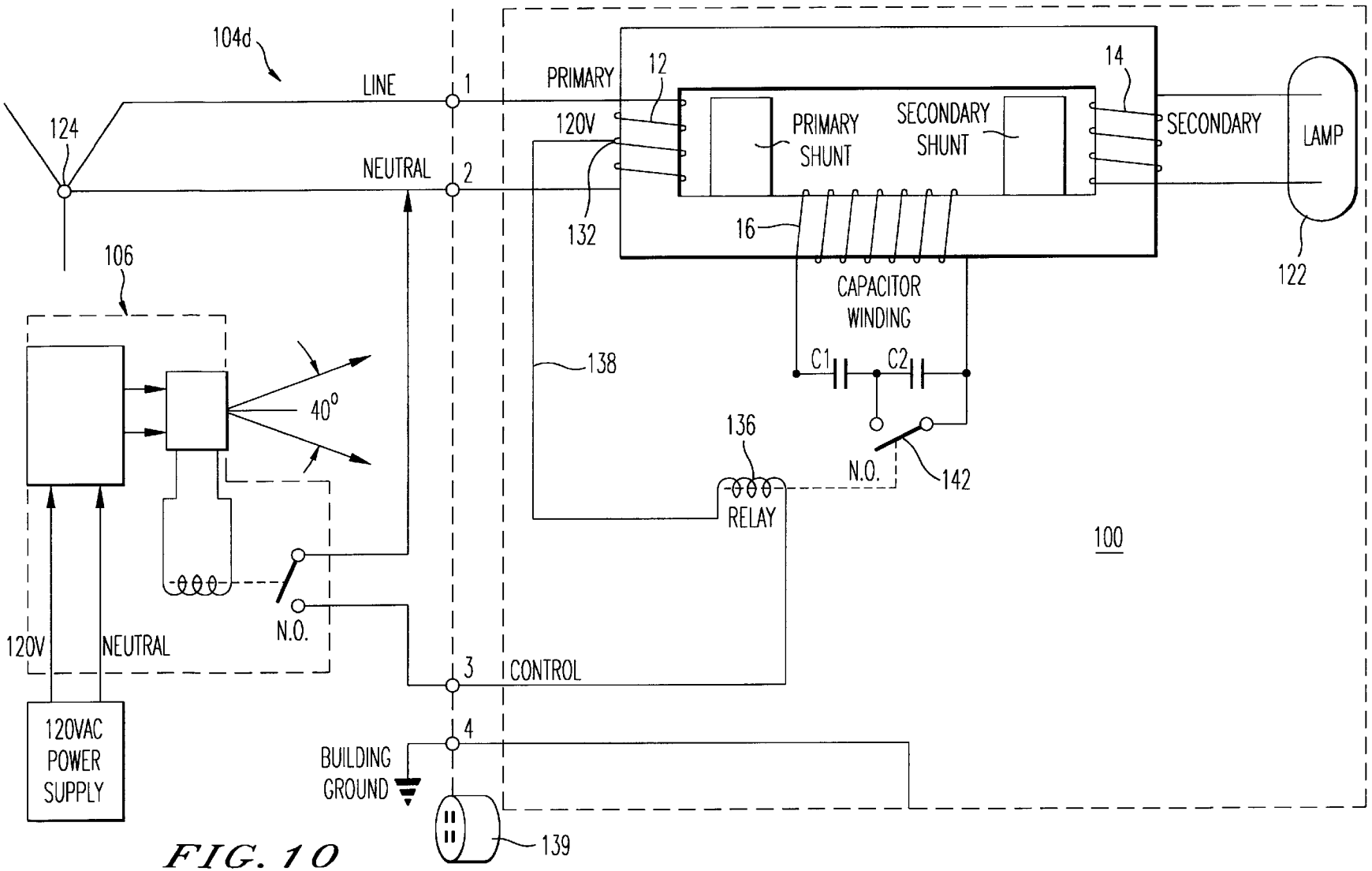

FIGS. 9 and 10 illustrate, respectively, a series and a parallel arrangement of capacitors C1 and C2 with a magnetic regulator such as the regulator 10 in FIG. 1. The control systems in FIGS. 9 and 10 operate in essentially the same manner as the circuits in FIGS. 5 and 8, respectively.

The power supplied to the in-fixture relay coil 136 from the 120 VAC center tap 132 is more advantageous than using a separate power source. Since only one voltage is supplied to the fixture (i.e., 120 VAC), the fixture is easier to disable. When the lamp requires maintenance, the electrician or user need only terminate power at the main power source 124. The user will not be subject to possible electrocution by wires carrying voltages from other sources of which the user is unaware.

Further, the in-fixture relay 136 is preferably a low wattage, high impedance device. Thus, even if the user were working on the lamp fixture while it was connected to the main power source 124, the control wire 140 carries a non-lethal voltage when it is active. In addition, because the in-fixture relay coil limits the current that can be delivered by the 120 VAC tap 132, the control system 104 is less likely to arc and ignite a fire or cause potentially lethal shock.

A number of lighting control systems in the prior art use control sensors which output a DC voltage signal to the lamp. The sensor of the present invention is configured to generate intelligent output signals (i.e., connecting a control wire to a neutral wire) to the fixtures using closure of isolated contact switches. The control system 104 is therefore safer to use because no voltage signal is being supplied to the fixture from the sensor.

The control circuit 104 is preferably provided with a time delay device (150 in FIG. 12) to allow the discharge lamp 122 to warm-up at full power, and to dim after a sufficient warm-up period. The time delay device is used when the control system is initially powered on and after an interruption in power which quenches the lamps. The time delay device can be provided to each fixture. Alternatively, the time delay device can be provided in each sensor or on an interface panel 144 comprising a plurality of sensors. The panel 144 is described below in connection with FIG. 11. A solid state timer such as the model number ERDM4115M 15 minute, 120 VAC timer made by Solid State Advanced Controls (SSAC) of Baldwinsville, N.Y., for example, can be used with a sensor 106 or a panel 144 comprising sensors. An SSAC timer model number THD74115MA 15 minute, 120 VAC, for example, can be used in a fixture. A PTC resistor can be used if a shorter time delay is desired.

The time delay device is preferably a two terminal device which suspends operation of the sensor and operates the lamp at full power for a predetermined period of time when the main power source is turned on or after a power outage. The period of time is preferably 15 minutes, which provides adequate time for full current to flow through the electrodes of the lamp 122 and therefore for the lamp to properly warm-up.

When the time delay device is placed at the sensor output between terminals 2 and 3, a short is preferably created between the control and neutral wires to bypass sensor operation. Thus, the in-fixture relay 136 closes and the lamp operates initially at full power. The time delay device is preferably a digital clock which begins a countdown as soon as the main power source is applied to the control system. When 15 minutes have elapsed, the time delay device opens and the sensor 106 operates as described above in connection with FIG. 5.

When the time delay device is applied between terminals 2 and 3 inside the fixture 100, the clock countdown does not begin until the main power source is powered on. The addition of a time delay device to each fixture increases the cost of a step-dimming system having a multitude of lamps. It is less costly to provide the time delay device across the neutral and control output wires of a sensor which services several lamps. Cost can be further reduced by placing the time delay device with a panel 144 (FIG. 11) which services many fixtures.

Figure 11:
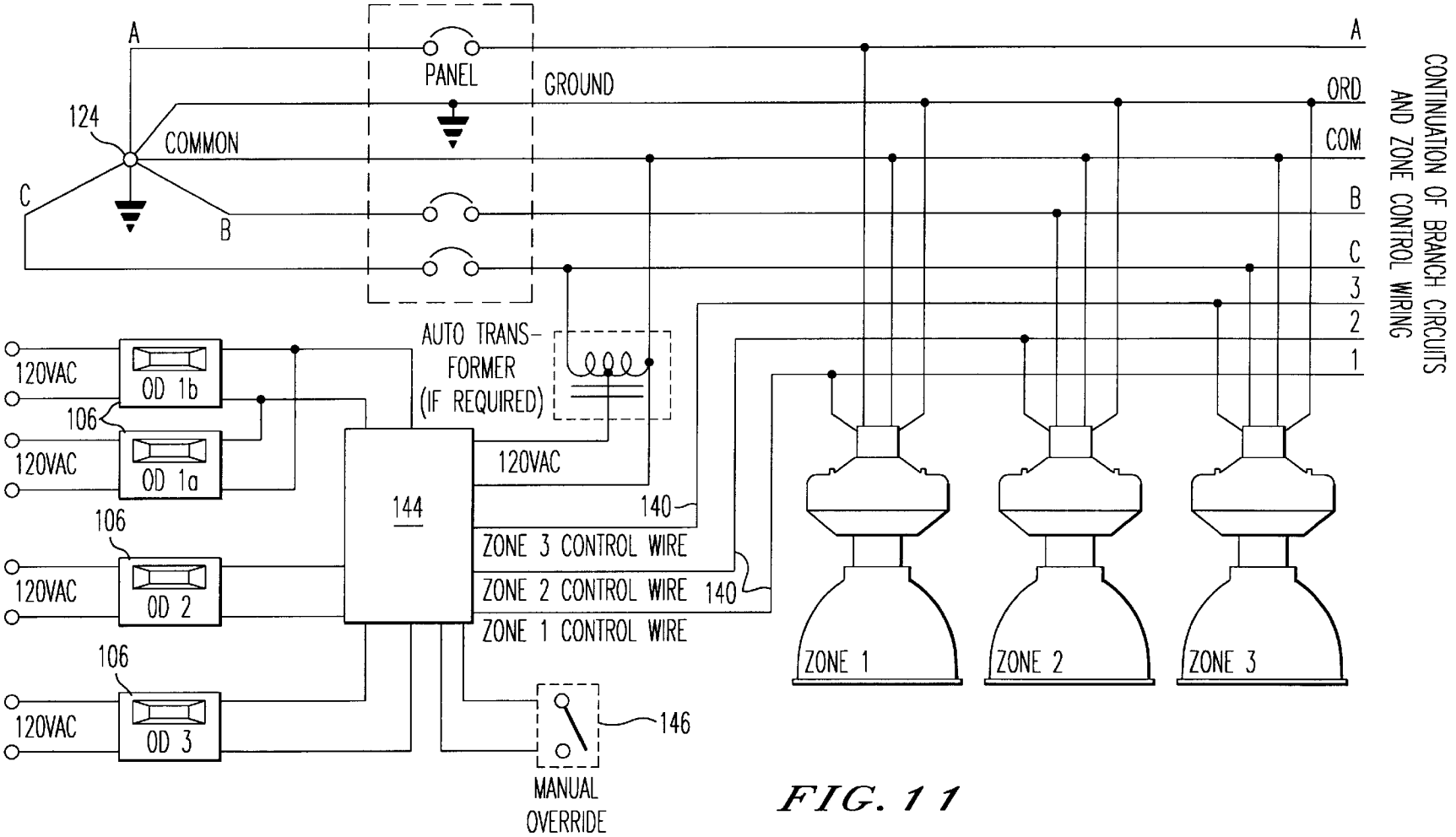
FIG. 11 is a schematic block diagram of a lighting control system comprising lamps arranged in a number of operational zones and controlled by a common interface panel.

In accordance with another embodiment of the present invention, sensors for several zones (e.g., warehouse aisles) can be arranged on a centralized interface panel (IP) 144, as shown in FIG. 11. The fixtures in FIG. 11 each represent one of possibly several fixtures in a zone. Thus, FIG. 11 illustrates a centralized panel for operating three different zones (e.g., three aisles in a warehouse). As described above in connection with FIG. 5, each lamp is provided with a standard 4-pin plug for connection to a line voltage wire (terminal 1), a neutral wire (terminal 2), a control wire (terminal 3) and to ground (terminal 4). The panel is configured with an output control wire for each zone, a manual override switch, a 120 VAC power source (e.g., power source 124), and inputs for a number of sensors or occupancy detectors (OD) 106 (at least three in this exemplary diagram).

Figure 12:
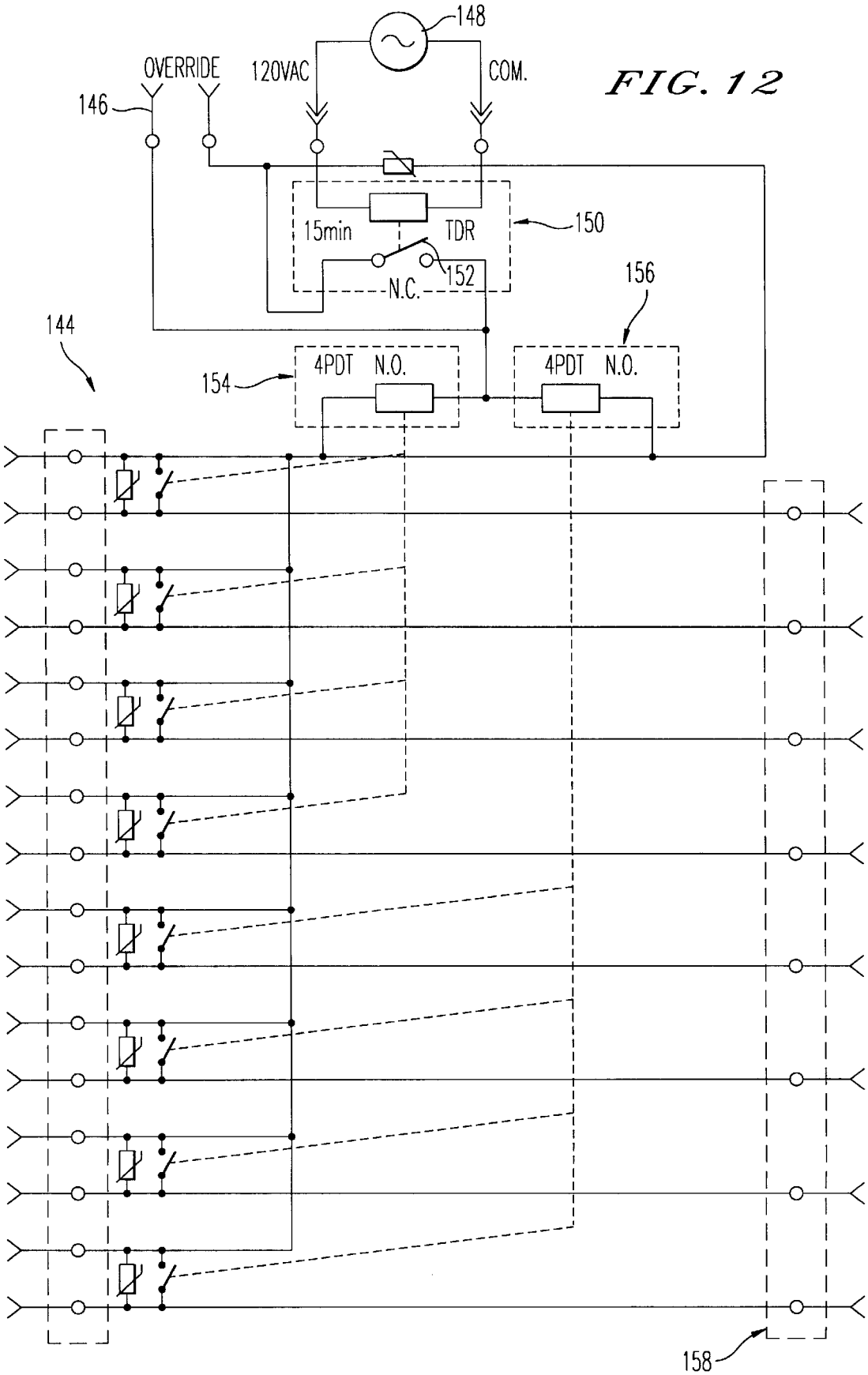
FIG. 12 is a schematic diagram of an interface panel constructed in accordance with the present invention.

FIG. 12 provides a more detailed illustration of the interface panel 144. The panel is configured to receive power from the 120 VAC power source 148. A time delay device 150 is connected between the line voltage and neutral wires, and delays opening a normally closed contact set 152 for approximately 15 minutes to bypass the sensors 106 until the lamp 100 has warmed up for a predetermined period of time. After the warm-up time elapses, the contacts 152 in the timer open and, accordingly, the eight contact sets of two, normally open, four-pole, double-throw type relays 154 and 156 open. The eight contact sets are connected to the outputs of eight respective sensors. The sensors operate to connect the control wire to neutral when a specified condition is detected. The eight terminals, shown collectively as 158, are control wires which are connected, respectively, to the fixtures in each zone.

Figure 3:
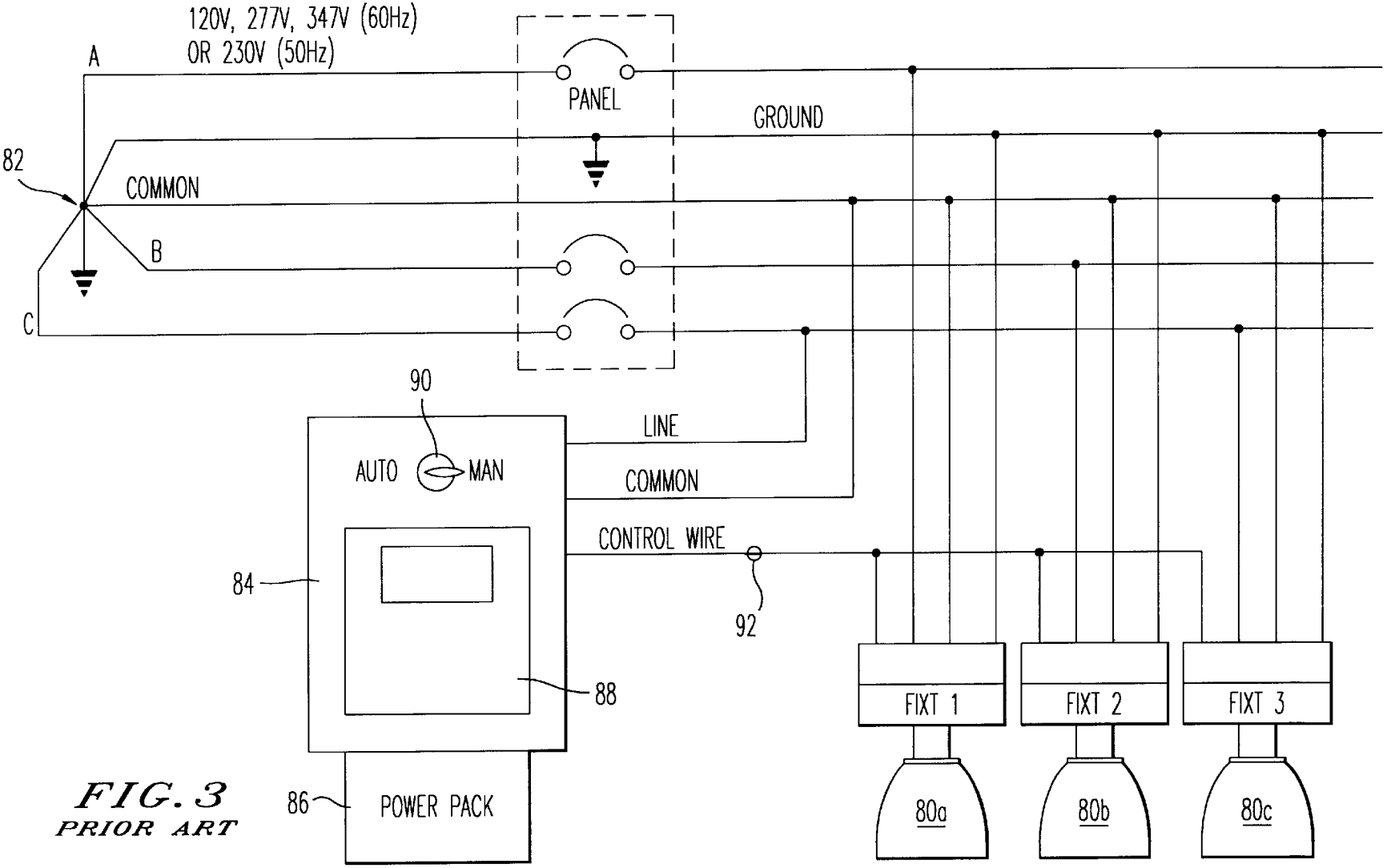
FIG. 3 PRIOR ART
FIG. 3 is a schematic diagram of a step-dimming control system for discharge lamps in accordance with the prior art.

Unlike the present invention illustrated in FIG. 11, the Ruud system shown in FIG. 3 connects sensors directly to the fixtures. Thus, a 10 to 15 minute delay for lamp warm-up is created per fixture. In contrast, the panel 144 reduces cost because fewer timers are used. The panel also eliminates lock-out for each fixture.

An advantage of the invention realized by using a 120 VAC control voltage level is the reduction of problems due to noise. A control signal loop comprising a 120 volt communications wire avoids interference of the control signal with noise attributable to low voltage signals. A number of lighting control systems in the prior art use sensors which generate low voltage control signals. The control signal of the present invention is derived from the neutral wire to eliminate these noise-producing output voltages. In addition, the 120 VAC control signal derived in each fixture to operate the dimming control relay 136 in that fixture permits the fixtures to operate independently of each other. The fixtures are therefore easier to maintain and troubleshoot.

Other advantages are realized by the invention due to switching a single control wire to neutral, which permits the use of a standard 4-pin plug and receptacle arrangement as opposed to a 5-pin, off-standard plug and connector. In addition, another voltage source does not have to be provided to the fixture since the tap 132 is used to generate the 120 volts needed to activate the relay 136. Besides not requiring an additional connector lead (i.e., a 5-pin, off-standard plug), the tap is beneficial because the circuits 104 do not have to meet additional insurance underwriting specifications because of an another external voltage source being provided to the fixture, and are therefore less costly to manufacture.

Figure 13:
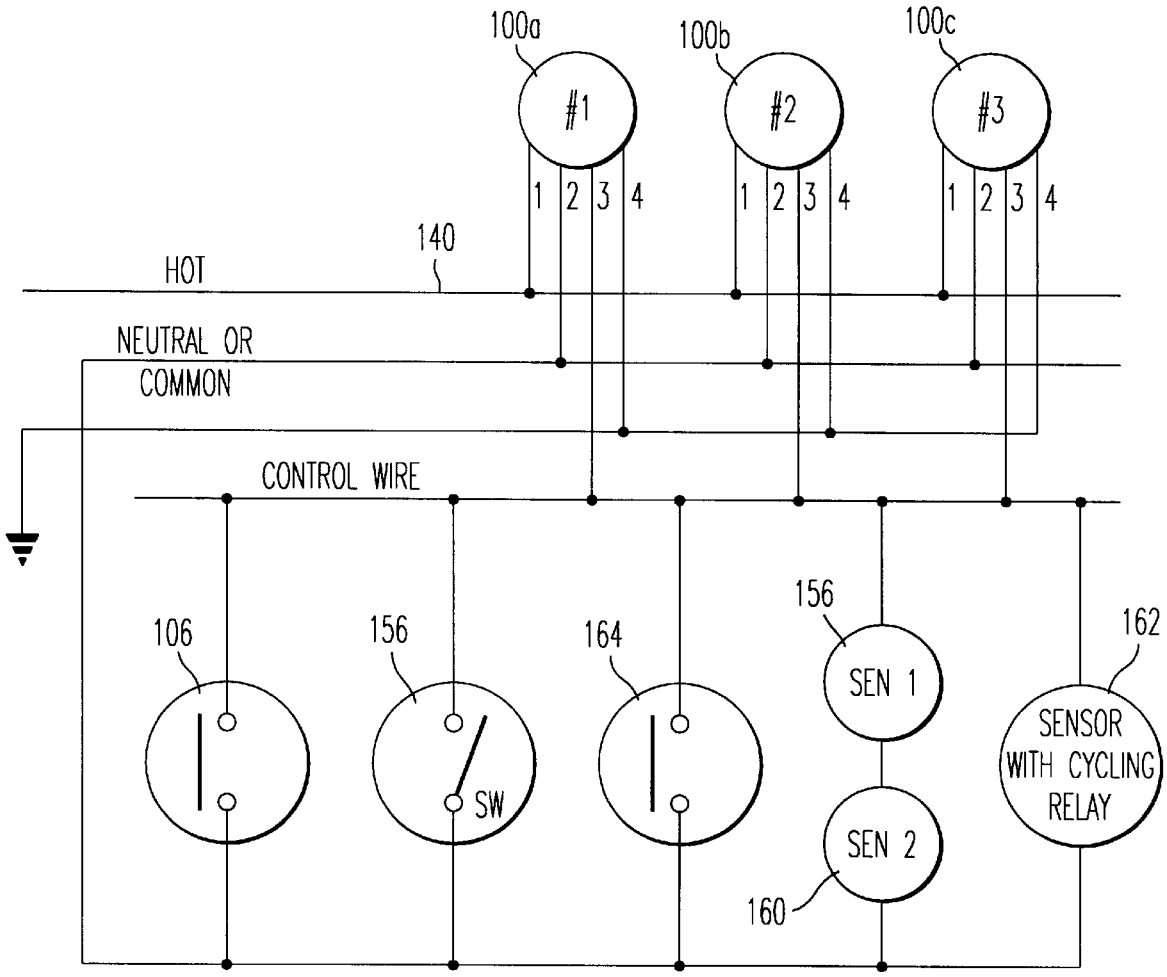
FIG. 13 is a partial, enlarged view of FIG. 4 illustrating various types of sensors, switches and control devices that can be used with the lighting control system of the present invention.

Since only a single control wire is used to communicate with individual fixtures or with arrays of fixtures to achieve step-dimming action, the control system is readily configurable for use with a variety of sensors, contact switches and control devices, as illustrated in FIG. 13. In addition to motion sensors 106, and override manual switches 156, the control system can be provided with combinations of input controls. For example, a first sensor 158 such as a smoke detector and a second sensor 160 such as a temperature sensor may be provided in series between the control and neutral wires. The fixtures, therefore, will not be operated at full power unless both sensors are activated. Two or more sensors can be digitally connected with AND and OR gates to achieve the desired combinations of conditions that must be met to operate the lamps at full power from a dimmed mode. Further, control input devices 164 can also be provided which activate the second control relay when an electromagnetic signal (i.e., IR or radio frequency) is received.

In accordance with another aspect of the invention, a sensor with a cycling relay 162 can be provided between the control and neutral wires to operate as a visible alarm. The cycling relay can be a 120 VAC relay coupled with a relaxation oscillator which together operate to periodically connect the control and neutral wires, thereby flashing the lamps between the dim and full wattage operation modes at an attention-getting rate (e.g., 15 hertz). By using combinations of sensors (e.g., motion, noise and smoke sensors) and optional sound alarms, the lighting control system can operate, for example, as burglary and fire emergency alarm systems having both visible and audible indicators.

A significant drawback to many dimming systems is the inefficiency and sometimes malfunctioning of discharge lamps operating under reduced wattage conditions. Discharge lamps are generally designed to operate in a thermonic emission or hot cathode mode, as opposed to a glow mode wherein the lamp current through the electrodes is permitted to decrease to a low value. As the electrode current decreases, a discharge lamp is more likely to malfunction due to electrode sputtering and rapid deterioration of the cathode emission mix. Thus, there is a minimum lamp operating current or wattage that should be used to achieve acceptable lamp life and lumens per watts (LPW) during low level operation.

There are differences in the stability of discharge lamps during low level operation depending on discharge lamp-type. For example, a mercury lamp is the most stable during reduced wattage operation because the plasma component is mercury. The mercury becomes condensed during low level operation; therefore, the vapor pressure decreases. Accordingly, the lamp operating voltage decreases toward a cold, lamp warm-up mode of operation. A MH lamp, on the other hand, can undergo significant and undesirable changes in color, LPW generation, wattage output during reduced wattage operation. When the sodium inside the lamp destroys the integrity of the quartz arc tube, the lamp can even shatter. An HPS lamp is relatively stable because it contains no quartz. Thus, as the sodium condenses, the arc tube is not subjected to chemical breakdown.

Discharge lamp manufacturers have set forth dimming guidelines to consider when operating a discharge lamp below normal wattage conditions which take into consideration the foregoing problems and limitations of discharge lamps. Many discharge lamp manufacturers limit, for example, the reduced operating wattage of a 400 watt MH lamp to 200 watts or 50 percent. If the lamp is installed to operate below these guidelines, the manufacturers generally do not honor the usual warranty on the lamp.

Many step-dimming lighting control systems reduce the input wattage of a lamp to approximately 50% in the dimmed mode. A problem exists because the output or lumens generated by the lamp (line 166) decreases at a greater rate with respect to decreasing input wattage of the ballast (line 168), as indicated by the graph in FIG. 14. For example, if a 400 watt MH lamp is being used in a fixture, and the input wattage is reduced to approximately 55%, the lumens per input wattage ratio decreases from approximately 86 during full wattage operation to approximately 51 during the dimmed mode, as indicated by the graph in FIG. 15. The efficiency level of lamp illumination in the dimmed mode is significantly reduced because the lamp is cold and operating inefficiently.

Manufacturers frequently calculate cost benefits of dimming systems using the number of input watts saved per fixture. This calculation, however, fails to take into consideration the reduction in system efficiency (illustrated here in terms of LPW) as the result of a lamp operating at reduced ballast input wattage and therefore at reduced temperature. In many applications wherein discharge lamps are typically dimmed approximately 80 percent of the time and operated at normal wattage only 20 percent of the time, significant reductions in the LPW generated by a dimmed lamp lessen the effectiveness of the dimming system at conserving energy.

In accordance with the present invention, lamp performance during low level or reduced-wattage operation can be improved by using a lower wattage discharge lamp that provides higher lamp watt loading, that is, operates closer to the optimum design point and therefore achieves higher lamp and system lumens-per-watt generation. More particularly, the lighting control system 104 reduces ballast input wattage during the dimmed mode while maximizing lamp efficiency, e.g., LPW generation. For example, instead of using a 400 watt MH lamp, a 250 watt lamp can be used. This lamp operates at closer to its design point when dimmed and therefore operates at approximately 300 input watts. During full wattage operation, the lamp can be overdriven since the full wattage operation is needed a relatively small amount of the time, i.e., 20%. The ballast 126 and the ballast capacitances C1 and C2 are selected experimentally to accommodate the selected lamp wattage as described above in connection with FIGS. 6 and 7.

While certain advantageous embodiments have been chosen to illustrate the invention, it will be understood by those skilled in the art that various changes and modifications can be made herein without departing from the scope of the invention as defined in the appended claims.

What is claimed is:

1. A step-dimming system for a discharge lamp comprising the combination of:

an alternating current power source comprising a line voltage wire for carrying a line voltage and a neutral wire for supplying at least one line voltage;

a fixture housing comprising no more than four terminals for controllably operating said discharge lamp and connecting said alternating current power source to said fixture housing, the four terminals including a first terminal connected to said line voltage wire, a second terminal connected to said neutral wire, a third terminal and a fourth terminal connected to ground;

a ballast disposed within said fixture housing and comprising an input side connected to said first and second terminals, respectively, for receiving said line voltage, an output side connected to said lamp, and a tap;

a first capacitor and a second capacitor disposed within said fixture housing and connected to said ballast to store energy therefrom;

a first control relay and a corresponding contact set disposed within said fixture housing and connected to said first capacitor to selectively increase and decrease energy provided to said lamp from said ballast, one end of said relay being connected to said tap and the other end of said relay being connected to said third terminal; and a second control relay and a corresponding contact set located remotely with respect to said fixture housing, one contact of said second control relay being connected to said neutral wire and another contact being connected to said third terminal to provide only a single output control wire to control said discharge lamp, said second control relay being operable to selectively connect and disconnect said single output control wire to said neutral wire to activate said first control relay, said first control relay in turn being operable to connect and disconnect said first capacitor from said ballast in response to said connection and disconnection of said single output control wire to said neutral wire to increase and decrease energy provided to said lamp from said ballast.

2. A step-dimming system as claimed in claim 1, wherein said second control relay and corresponding said contact set are located in a sensor that is powered-on independently of said fixture.

3. A step-dimming system as claimed in claim 2, wherein said sensor is one of a plurality of sensors comprising a motion sensor, a noise sensor, a temperature sensor, an ambient light sensor, and a smoke sensor.

4. A step-dimming system as claimed in claim 1, wherein said first capacitor and said contact set of said first control relay are connected in series with each other, and together are connected parallel to said second capacitor.

5. A step-dimming system as claimed in claim 1, wherein said first capacitor and said second capacitor are connected in series with each other, and said contact set of said first control relay is connected parallel to said first capacitor.

6. A step-dimming system for a discharge lamp comprising the combination of:

an alternating current power source comprising a line voltage wire for carrying a line voltage and a neutral wire for supplying at least one line voltage;

a fixture housing comprising no more than four terminals for controllably operating said discharge lamp and connecting said alternating current power source to said fixture housing, the four terminals including a first terminal connected to said line voltage wire, second terminal connected to said neutral wire, a third terminal and a fourth terminal connected to ground;

a ballast disposed within said fixture housing and comprising an input side connected to said first and second terminals, respectively, for receiving said line voltage and an output side connected to said lamp;

a first capacitor and a second capacitor disposed within said fixture housing and coupled to said ballast to store and control the supply of energy therefrom to said lamp;

a first control relay and corresponding contact set disposed within said fixture housing, said first control relay having one end configured to receive an alternating current line voltage from said ballast, the other end of said relay connected to said third terminal, said contact set connected to said first capacitor and operable to open and close in accordance with activation of said first control relay; and a second control relay and corresponding contact set located remotely with respect to said fixture housing, one contact of said second control relay being connected to said neutral wire and another contact being connected to said third terminal to provide only a single output control wire to control said discharge lamp, said second control relay being operable to selectively connect and disconnect said single output control wire to said neutral wire to activate said first control relay, said first control relay in turn being operable to connect and disconnect said first capacitor from said ballast in response to said connection and disconnection of said single output control wire to said neutral wire to increase and decrease energy provided to said lamp from said ballast.

7. A step-dimming system as claimed in claim 6, wherein said first capacitor and said contact set of said first control relay are connected in series with each other, and together are connected parallel to said second capacitor.

8. A step-dimming system as claimed in claim 6, wherein said first capacitor and said second capacitor are connected in series with each other, and said contact set of said first control relay is connected parallel to said first capacitor.

9. A step-dimming system as claimed in claim 6, further comprising a manually operated switch to activate said second control relay.

10. A step-dimming system as claimed in claim 6, further comprising a control device for activating said second control relay upon receipt of an electromagnetic signal.

11. A step-dimming system as claimed in claim 10, wherein said signals are radio frequency signals.

12. A step-dimming system as claimed in claim 10, wherein said signals are infrared signals.

13. A step-dimming system as claimed in claim 6, further comprising a sensor configured with said second control relay and corresponding contact set at its output, said sensor being operable to activate said second control relay when a predetermined condition is detected.

14. A step-dimming system as claimed in 13, wherein said sensor is one of a plurality of sensors comprising a motion sensor, an ambient light sensor, a smoke sensor, a noise dectector and a temperature sensor.

15. A step-dimming system as claimed in claim 13, further comprising a plurality of sensors, at least one of said sensors having said second control relay and corresponding said contact set at its output, said sensors being connected together using at least one combinational logic device, wherein said sensors operate together in accordance with said combinational logic device to activate said second control relay.

16. A step-dimming system as claimed in claim 13, further comprising a second power source connected to said sensor, said sensor being connected to said first control relay by a single output control wire connected to said third terminal.

17. A step-dimming system as claimed in claim 16, wherein said fixture housing is supplied with power from only said power source.

18. A step-dimming system as claimed in claim 13, further comprising a plurality of said lamps arranged in a plurality of zones, a plurality of said sensors, at least one of said plurality of sensors being adapted to monitor respective said zones, and an interface panel connected to each of said plurality of sensors, said interface panel being configured to provide a unitary output wire from each of said plurality of sensors to said third terminal of corresponding ones of said lamps.

19. A step-dimming systems as claimed in claim 18, wherein said interface panel comprises a time delay device for bypassing said sensors for a predetermined lamp warm-up period.

20. A step-dimming system as claimed in claim 6, wherein said first control relay is a low voltage, high impedance inductor.

21. A step-dimming system as claimed in claim 6, wherein said second control relay is a low voltage, high impedance inductor.

22. A step-dimming system as claimed in claim 6, wherein said contact set corresponding to said first control relay is normally open, said contact set corresponding to said second control relay is normally open, said first relay being energized when said second contact set closes and said output control wire is connected to said neutral wire, said first contact set in turn being closed to increase ballast capacitance generated by said first capacitor and said second capacitor.

23. A step-dimming system as claimed in claim 6, further comprising one of a standard four pin plug and receptacle connected to said line voltage wire, said neutral wire, said single output control wire and said ground.

24. A step-dimming system as claimed in claim 6, further comprising a time delay device connected between said neutral wire and said third terminal, said time delay device being operable to bypass said second control relay to operate said lamp for a predetermined lamp warm-up period.

25. A step-dimming system as claimed in claim 6, wherein said second control relay is connected to a relaxation oscillator to flash said lamp between dimmed and normal wattage operational modes at an attention-getting rate.

26. A method as claimed in claim 24, further comprising the step of sensing a predetermined condition before closing said contact set of said second switch.

27. A method as claimed in claim 24, further comprising the step of connecting said terminal of said inductive switch to a tap on said ballast.

28. A method of switching a discharge lamp from a dimmed mode to a normal wattage operating mode, comprising the steps of:

supplying a line voltage to a ballast;

connecting a terminal of an isolated, inductive switch to said ballast, said inductive switch comprising a normally open contact set connected in series with a first capacitor, said contact set and said first capacitor being parallel to a second capacitor, said inductive switch being operable to selectively close said contact set;

connecting another terminal of said inductive switch to the output control wire of a second switch, said second switch comprising a normally open contact set coupled between a neutral wire of said power source and said output control wire; and closing said contact set of said second switch to connect said output control wire to said neutral wire.

29. A step-dimming apparatus for a discharge lamp, the step-dimming apparatus being connected to a control circuit for selectively operating the discharge lamp and to an alternating current power source, the control circuit comprising a switch, the alternating current power source having a line voltage wire for carrying a line voltage and a neutral wire, the step-dimming apparatus comprising:

a fixture housing enclosing said lamp and having no more than four terminals for connecting said control circuit and said alternating current power source to said fixture housing, said four terminals including a first terminal connected to said line voltage wire, a second terminal connected to said neutral wire, a third terminal and a fourth terminal connected to ground;

a ballast disposed within said fixture housing and comprising an input side connected to said first and second terminals, respectively, for receiving said line voltage, and an output side connected to said lamp;

a first capacitor and a second capacitor disposed in said fixture housing and coupled to said ballast to store and control the supply of energy therefrom to said lamp; and a first control relay and a first contact set disposed within said fixture housing, said first control relay having one end configured to receive an alternating current line voltage from said ballast, the other end of said first control relay being connected to said third terminal, said first contact set being connected to said first capacitor and operable to open and close in accordance with activation of said first control relay;

wherein said control circuit is located remotely with respect to said fixture housing, one end of said switch in said control circuit being connected to said neutral wire and another end of said switch being connected to said third terminal via a conductor, said switch being operable to selectively connect and disconnect said neutral wire to said third terminal to activate said first control relay, said first control relay being operable to connect and disconnect said first capacitor from said ballast in response to said connection and disconnection of said third terminal to said neutral wire to increase and decrease energy provided to said discharge lamp from said ballast.

30. A system comprising the discharge lamp and the step-dimming apparatus as claimed in claim 29, the system further comprising a second discharge lamp and a second step-dimming apparatus comprising:

a second fixture housing enclosing said second lamp and having no more than four terminals for connecting said control circuit and said alternating current power source to said second fixture housing, said four terminals including a first terminal connected to said line voltage wire, a second terminal connected to said neutral wire, a third terminal and a fourth terminal connected to ground;

a second ballast disposed within said second fixture housing and comprising an input side connected to said first and second terminals of said second fixture housing, respectively, for receiving said line voltage, and an output side connected to said second lamp;

a first capacitor and a second capacitor disposed in said second fixture housing and coupled to said second ballast to store and control the supply of energy therefrom to said second lamp; and a second control relay and a second contact set disposed within said second fixture housing, said second control relay having one end configured to receive an alternating current line voltage from said second ballast, the other end of said second control relay being connected to said third terminal of said second fixture housing, said second contact set being connected to said first capacitor of said second fixture housing and operable to open and close in accordance with activation of said second control relay in said second fixture housing;

wherein said control circuit is located remotely with respect to said second fixture housing, one end of said switch in said control circuit being connected to said neutral wire and another end of said switch being connected to said third terminal of said second fixture housing via said conductor, said switch being operable to selectively connect and disconnect said neutral wire to said third terminal of said second fixture housing to activate said first control relay in said second fixture housing, said second control relay being operable to connect and disconnect said first capacitor in said second fixture housing from said second ballast in response to said connection and disconnection of said third terminal of said second fixture housing to said neutral wire to increase and decrease energy provided to said second lamp from said second ballast, said conductor connecting said first control relay in said step-dimming apparatus and said second control relay in said second step-dimming apparatus to said neutral line in accordance with the operation of said switch.

* * * * *